US006084327A

United States Patent [19]

Steffen

[11] Patent Number: 6,084,327

[45] Date of Patent: Jul. 4, 2000

[54] INTERNAL VIBRATOR SUPPLIED WITH CURRENT FROM A TRANSFORMER

[75] Inventor: Michael Steffen, Gauting, Germany

[73] Assignee: Wacker Werke GmbH & Co. KG, Germany

[21] Appl. No.: 08/175,718

[22] Filed: Dec. 30, 1993

[30] Foreign Application Priority Data

Dec. 30, 1992 [DE] Germany ..... 92 17 854 U

[51] Int. Cl.[7] ..... H02K 11/00

[52] U.S. Cl. ..... 310/81; 310/47; 310/48; 310/50; 310/68 D

[58] Field of Search ..... 310/81, 80, 68 D; 366/123

[56] References Cited

U.S. PATENT DOCUMENTS

| | | | |
|---|---|---|---|
| 2,116,708 | 5/1938 | Niekamp | 366/123 |
| 2,478,701 | 8/1949 | Maginniss | 310/88 |
| 2,924,730 | 2/1960 | Spitler | 310/81 |
| 2,940,326 | 6/1960 | Meyer | 74/87 |
| 2,945,970 | 7/1960 | Nordegren | 310/81 |
| 3,202,402 | 8/1965 | Giertz-Hedstrom | 366/123 |
| 3,529,190 | 9/1970 | Fontaine | 310/81 |
| 3,601,368 | 8/1971 | Uebel | 366/121 |
| 3,782,693 | 1/1974 | Strohbeck | 366/122 |
| 3,784,168 | 1/1974 | Schneider et al. | 366/122 |

*Primary Examiner*—Elvin Enad
*Attorney, Agent, or Firm*—Robert W. Becker & Associates

[57] ABSTRACT

An internal vibrator for compacting concrete and having a vibrator housing in which is disposed an eccentric mass and an electric motor for driving the eccentric mass. The electric motor is supplied via a power supply cord with electric current having a frequency that is greater than line frequency. The vibrator comprises a switch for controlling the electric motor, and also includes a transformer for supplying to the electric motor the electric current having the frequency that is greater than line frequency. The switch and the transformer are combined in a common housing to form a miniaturized built-in unit on the power supply cord.

3 Claims, 1 Drawing Sheet

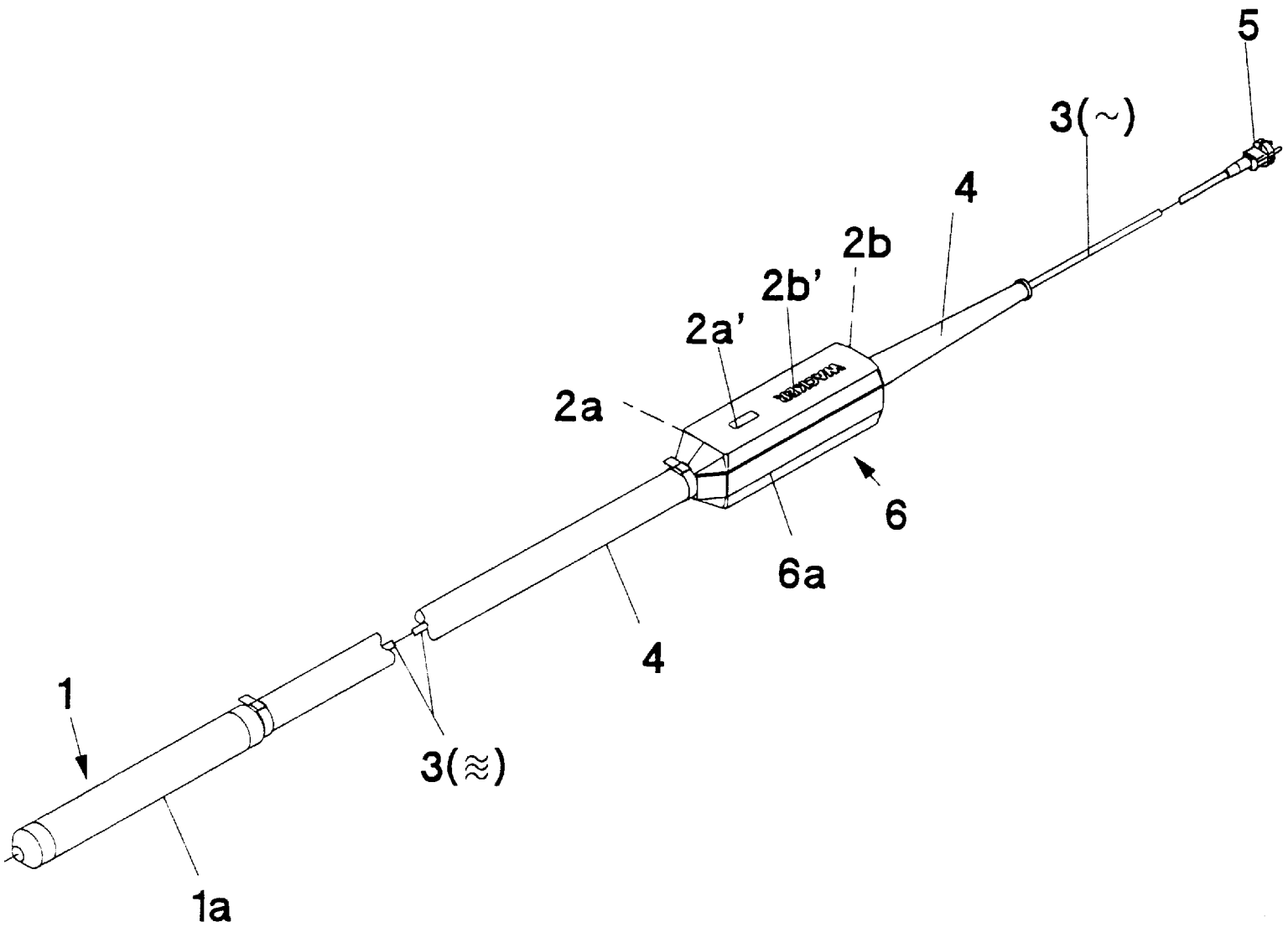
5
3(2)
4
2b
2b'
2a'
2a
6
6a
4
3(3)
1a
1

INTERNAL VIBRATOR SUPPLIED WITH CURRENT FROM A TRANSFORMER

BACKGROUND OF THE INVENTION

The present invention relates to an internal vibrator for compacting concrete and having a vibrator housing in which is disposed an eccentric mass and an electric motor for driving the eccentric mass. The electric motor is supplied via a power supply cord, from a transformer, with electric current having a frequency that is greater than line frequency. The power supply cord is disposed at least in part in a protective and operating tube, with a switch being provided in the power supply cord for turning the electric motor on and off.

With the heretofore known internal vibrators, the converters or transformers have been provided as devices that are separate from the vibrators and that at a construction site are connected to a main power supply and to which then the plugs of the power supply cords of one or more vibrators are connected.

It is therefore an object of the present invention to simplify the use and operation of internal vibrators of the aforementioned general type.

BRIEF DESCRIPTION OF THE DRAWING

This object, and other objects and advantages of the present invention, will appear more clearly from the following specification in conjunction with the accompanying schematic drawing, which is a side view of one exemplary embodiment of the inventive internal vibrator.

SUMMARY OF THE INVENTION

The internal vibrator of the present invention is characterized primarily by: switch means for controlling the electric motor, with the switch means being disposed in the power supply cord in the vicinity of the protective and operating tube; and a transformer for supplying to the electric motor the electric current having the frequency that is greater than line frequency, wherein the switch means and the transformer are combined in a common housing to form a miniaturized built-in unit on the power supply cord.

In contrast to the heretofore known systems where the transformers were components that were separate from the internal vibrator itself, the inventive internal vibrator has the following special advantages:

1. The transformer is connected to the pertaining internal vibrator so that it cannot be forgotten nor can it become detached;
2. Since each internal vibrator has associated therewith its own individual transformer, a possibility for switching over to various operating frequencies can be more frequently utilized than where a single transformer is used for several internal vibrators;
3. When the internal vibrator is shut off, the transformer is also completely shut off; and
4. A possible failure of the transformer affects only a single internal vibrator.

Further specific features of the present invention will be described in detail subsequently.

DESCRIPTION OF PREFERRED EMBODIMENTS

Referring now to the drawing in detail, the illustrated internal vibrator has a vibrating cylinder 1, in the vibrator housing 1*a* of which is installed an electric motor that is not visible in the drawing. The electric motor imparts a rotational movement, about the longitudinal axis of the vibrating cylinder 1, to an out-of-balance or eccentric mass that is also disposed in the vibrator housing 1*a*. The electric motor operates with a frequency that is higher than the general power supply or line frequency. Electrical energy is supplied to the electric motor via a switch means 2*a* that is built into the power supply cable or cord 3 at such a distance from the vibrating cylinder 1 that the switch means is still disposed externally of the concrete when the vibrating cylinder 1 is lowered into the concrete that is to be compacted to a maximum operating length of the vibrating cylinder. Conventional maximum operating lengths are, for example, 6 m. Over this distance between the vibrating cylinder 1 and the switch means 2*a,* the power supply cord 3 is surrounded by a protective and operating hose or tube 4 that is made of wear-resistant yet flexible material. The protective tube 4, as shown in the drawing, customarily also extends somewhat beyond the switch means 2*a*. Disposed at the end of the power supply cord 3 is a plug 5.

The structure described up to this point is known. With heretofore known vibrators of this type, the plug 5 was connected to a converter or transformer that delivered alternating current of a frequency higher than the line frequency and that itself was connected via a further power supply cord to the main power supply or to a generator on the site that operated with line frequency. The electric motor that is built into the vibrating cylinder is customarily a three-phase motor so that the transformer is designed to deliver a three-phase current having a frequency that is higher than the line frequency.

The inventive internal vibrator that is illustrated in the drawing differs from the heretofore known vibrator in that the converter or transformer 2*b* is installed in the power supply cord 3, i.e. in the protective and operating tube 4, at the location of the operating switch 2*a* for the vibrating cylinder 1, and is combined with the operating switch to form a miniaturized built-in unit 6 that has a common housing 6*a*. Similar to the on/off switches or "controllers" of the known internal vibrators, the built-in unit is disposed in the protective tube 4 without forming a disruptive obstacle during use of the internal vibrator, and in addition the built-in unit is permanently connected to the vibrating cylinder 1 so that the latter has associated therewith its own transformer that cannot be forgotten and cannot become detached.

Up to the point of the built-in unit 6, the power supply cord 3 can be embodied as a single-phase, alternating current line with a protective or grounded conductor. In such a case, the transformer 2*b* generates the higher frequency three-phase current from the single-phase, alternating current with line frequency that is supplied to it. Switching arrangements or circuitry that are capable of doing this are fundamentally known, so that details of the transformer 2*b* itself need not be provided here. What is critical to the design of the present invention is a maximum miniaturization, within known constraints, of the combination of the switch means 2*a* and the transformer 2*b*.

The switch portion 2*a* of the built-in unit 6 can be controlled, as desired, by the operator of the internal vibrator in a conventional manner by an actuating element 2*a'*.

The transformer 2*b* can also be designed, in a known manner, to deliver to the electric motor in the vibrating cylinder 1 a supply current of variable frequency. In this case, a further actuating element 2*b*' is provided on the built-in unit 6 to allow an operator to control the frequency.

The present invention is, of course, in no way restricted to the specific disclosure of the specification and drawing, but also encompasses any modifications within the scope of the appended claims.

What I claim is:

1. An internal vibrator for compacting concrete and having a vibrator housing in which is disposed an eccentric mass and an electric motor for driving said eccentric mass, said electric motor being supplied via a power supply cord with electric current having a frequency that is greater than line frequency, said power supply cord being disposed at least in part in a protective and operating tube, said vibrator further comprising:

switch means for controlling said electric motor, said switch means being disposed in said power supply cord in the vicinity of said protective and operating tube; and a transformer for supplying to said electric motor said electric current having said frequency that is greater than line frequency, wherein said switch means and said transformer are combined in a common housing to form a miniaturized built-in unit on said power supply cord.

2. The internal vibrator according to claim 1, wherein said built-in unit has an elongated external contour.

3. The internal vibrator according to claim 1, wherein said transformer is designed to generate three-phase current from single-phase alternating current.

* * * * *